US011952742B2

(12) United States Patent
Churchill et al.

(10) Patent No.: US 11,952,742 B2
(45) Date of Patent: Apr. 9, 2024

(54) LIP FOR EXCAVATING BUCKET

(71) Applicant: ESCO GROUP LLC, Portland, OR (US)

(72) Inventors: Robin K. Churchill, Aloha, OR (US); Michael B. Roska, Portland, OR (US); Ulf Daniel Widlund, Portland (SE)

(73) Assignee: ESCO GROUP LLC, Portland, OR (US)

( * ) Notice: Subject to any disclaimer, the term of this patent is extended or adjusted under 35 U.S.C. 154(b) by 794 days.

(21) Appl. No.: 16/832,185

(22) Filed: Mar. 27, 2020

(65) Prior Publication Data

US 2020/0308804 A1 Oct. 1, 2020

Related U.S. Application Data

(60) Provisional application No. 62/824,949, filed on Mar. 27, 2019.

(51) Int. Cl.

| | |
|---|---|
| ***E02F 3/40*** | (2006.01) |
| ***C21D 6/00*** | (2006.01) |
| ***C21D 9/00*** | (2006.01) |
| ***E02F 3/60*** | (2006.01) |

(52) U.S. Cl.

CPC ..... *E02F 3/60* (2013.01); *C21D 6/004* (2013.01); *C21D 9/0068* (2013.01); *E02F 3/40* (2013.01); *C21D 2211/008* (2013.01)

(58) Field of Classification Search

CPC ... E02F 3/40; E02F 3/60; C21D 6/004; C21D 6/005; C21D 9/0068; C21D 2211/008; C22C 38/02; C22C 38/04; C22C 38/044

See application file for complete search history.

(56) References Cited

U.S. PATENT DOCUMENTS

| | | | | |
|---|---|---|---|---|
| 1,876,411 A | | 9/1932 | Gregg | |
| 1,876,724 A | | 9/1932 | Gregg | |
| 1,894,820 A | | 1/1933 | Gregg | |
| 3,663,215 A | * | 5/1972 | Tanczyn | C22C 38/34 420/586 |
| 3,900,316 A | | 8/1975 | Jones | |
| 4,058,417 A | * | 11/1977 | Bicicchi | C22C 38/44 416/241 B |
| 5,129,966 A | | 7/1992 | Rao | |
| 5,180,450 A | * | 1/1993 | Rao | C22C 38/42 148/579 |
| 5,232,520 A | | 8/1993 | Oka et al. | |

(Continued)

FOREIGN PATENT DOCUMENTS

| | | |
|---|---|---|
| CN | 205444290 U | 8/2016 |
| GB | 1148258 A | 4/1969 |
| KR | 101250165 B1 | 4/2013 |

OTHER PUBLICATIONS

Matweb Material Property Data, "Overview of materials for Low Carbon Steel", Apr. 29, 2018 http://web.archive.org/web/20180429150058/https://www.matweb.com/search/DataSheet.aspx?MatGUID=034970339dd14349a8297d2c83134649 (Year: 2018).*

*Primary Examiner* — Jamie L McGowan

(74) *Attorney, Agent, or Firm* — Steven Schad; Palmer Dzurella

(57) ABSTRACT

A cast lip for an excavating bucket composed of a ferrous alloy having at least seven percent chromium by weight, 3%-6% nickel by weight, and ≤0.12% carbon by weight, and a primarily martensitic structure.

9 Claims, 5 Drawing Sheets

(56) References Cited

U.S. PATENT DOCUMENTS

| | | | | |
|---|---|---|---|---|
| 5,714,116 | A * | 2/1998 | Beguinot | C22C 38/44 420/105 |
| 5,785,109 | A | 7/1998 | Hongawa | |
| 5,888,318 | A * | 3/1999 | Morinaga | C22C 38/54 420/36 |
| 5,916,382 | A * | 6/1999 | Sato | C30B 29/52 148/404 |
| 7,266,914 | B2 * | 9/2007 | Grant | E02F 9/2883 37/444 |
| 9,499,959 | B2 | 11/2016 | Zamorano et al. | |
| 9,963,853 | B2 * | 5/2018 | Ollinger, IV | E02F 9/2816 |
| 2009/0047543 | A1 * | 2/2009 | Garber | E02F 9/2883 428/687 |
| 2013/0318840 | A1 | 12/2013 | Ollinger, IV et al. | |
| 2015/0211098 | A1 * | 7/2015 | Li | C21D 8/021 148/330 |
| 2016/0298451 | A1 * | 10/2016 | Feistritzer | C22C 38/48 |
| 2020/0308804 | A1 * | 10/2020 | Churchill | C21D 6/004 |

* cited by examiner

LIP FOR EXCAVATING BUCKET

RELATED APPLICATION

This application claims the benefit of priority from U.S. Prov. Pat. App. Ser. No. 62/824,949, filed Mar. 27, 2019, the entirety of which is incorporated by reference.

FIELD OF THE DISCLOSURE

The present disclosure pertains to a lip for an excavating bucket for use by excavating machines such as dragline machines, cable shovels, face shovels, hydraulic excavators and the like.

BACKGROUND OF THE DISCLOSURE

Excavating machines, such as used in mining and construction operations, include buckets that engage the ground to gather a load of earthen material. The bucket is generally defined by a rear wall, a bottom wall and sidewalls to define a cavity with an open front for receiving the excavated material. The front edge of the bottom wall is provided with a lip on which ground engaging tools such as teeth, adapters and/or shrouds are generally attached to protect the lip against wear and to better break up the ground during digging. The lips are either formed of plate steel (which are called plate lips) or by a casting process (which are called cast lips).

SUMMARY OF THE DISCLOSURE

In a first example, a cast lip for excavating equipment is composed of a ferrous alloy having at least 7% chromium, by weight, and a primarily martensitic structure.

In another example, a cast lip for excavating equipment is composed of a ferrous alloy having at least 7% chromium, at least 3% nickel and 0.12% or less carbon, and a primarily martensitic structure.

In another example, a cast lip for excavating equipment is composed of a ferrous alloy having at least 10% chromium, at least 3% nickel and 0.12% or less carbon, and optionally 3% or less of one or more of manganese, silicon and/or molybdenum, and a primarily martensitic structure.

In another example, a cast lip for excavating equipment is composed of a ferrous alloy having 10%-15% chromium, 3%-6% nickel and 0.12% or less carbon, and a primarily martensitic structure In another example, a cast lip for excavating equipment is composed of a ferrous alloy having 10%-15% chromium, 3%-6% nickel, and ≤0.10% each of carbon, manganese, silicon and molybdenum, and a primarily martensitic structure.

In another example, a cast lip for excavating equipment is composed of a ferrous alloy having from 7% to 10% chromium, at least 3% nickel and 0.12% or less carbon, and a primarily martensitic structure.

In another example, a cast lip for excavating equipment is composed of a ferrous alloy having 7-9% chromium, and 0.12% or less carbon, and a primarily martensitic structure.

In another example, a cast lip for excavating equipment is composed of an alloy having the same constituent makeup as a CA6NM alloy, and a primarily martensitic structure.

In another example, a cast lip for excavating equipment is composed of a low-carbon stainless steel having a primarily martensitic structure.

In another example, a lip having any of the above-noted alloys is formed by sand casting and/or air hardening processes.

In another example, a cast lip having any of the above-noted alloys includes an inner surface and an outer surface, wherein the outer surface includes recesses, which, for example, can reduce the overall weight of the lip.

In another example, a cast lip having any of the above-noted alloys includes a curved portion at least near each end of the lip such that the lip ends bend upward and generally align with the sidewalls of the bucket. Such a lip is suited for use with a cable shovel though other uses may be possible. Optionally, the outer surface of the lip includes recesses.

Each of the above-noted examples of the disclosure are suited for use as a cast lip for a large excavating bucket such as found in draglines, cable shovels, face shovels and hydraulic excavators. Such lips extend across the width of the bucket to form the primary digging edge. Such lips can, e.g., weigh as much as about 30,000 pounds, and/or can have a maximum thickness of about nine inches or more.

Lips in accordance with the present disclosure can provide improvements in yield strength, fatigue strength and/or endurance limits regarding welds, hardness and/or wear life as compared to current low alloy steel cast lips.

In one example of a process for making cast lips in accordance with the present disclosure, one of the above-noted ferrous alloys is melted, the molten alloy is fed into a sand mold to form the alloy into a lip structure for use with excavating equipment, hardening the alloy to give it a primarily martensitic structure, and then tempering the lip for toughness. In one example, the lip is air hardened.

A cast lip in accordance with the present disclosure can be repaired, rebuilt, secured in the bucket and/or provided with attachments by welding processes. In one example, the welding is accomplished by a weld material that is the same or similar to the alloy of the base material In one other example, the lip and weld material are each a chromium ferrous alloy. In another example, the lip is composed of a CA6NM alloy and the weld material is Type 309 stainless steel.

DETAILED DESCRIPTION OF PREFERRED EXAMPLES

Figure 1:
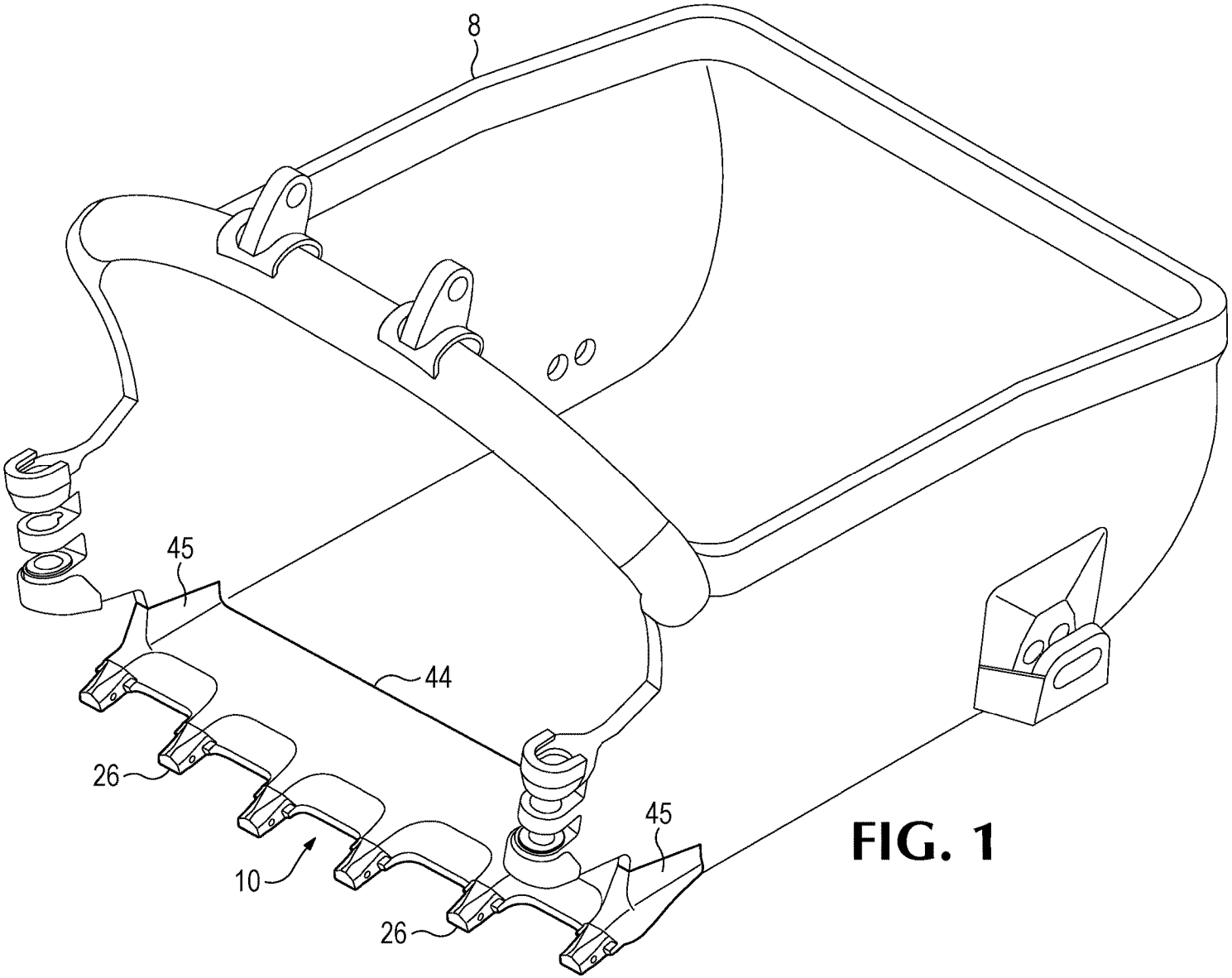
FIG. 1 is a perspective view of an excavating bucket with a lip in accordance with the present disclosure.

The present disclosure pertains to cast lips for excavating buckets such as used with dragline machines, cable shovels, face shovels, hydraulic excavators and the like.

Cast lips are large steel structures that extend across the width of a bucket for a digging machine, typically a large mining machine, to form its primary digging edge. Lips can be formed by casting the entire lip in one mold or by casting lip segments that are welded together to form a complete lip. For example, cast lips can weigh on the order of about 6500 pounds to about 29,000 pounds. Lip segments are typically smaller; as one example, an end segment can weigh about 2000 pounds. Cast lips tend to have a maximum thickness of about 9 inches or more. Often, they range from about 4-16 inches maximum thickness though other variations are possible. The thickness dimension is the distance between the inner and outer faces of the lip. Cast lips may include forwardly-projecting noses for mounting excavating teeth. The noses are often cast integrally with the lip or lip segments. Noses can also be cast separately and welded to the front of the lip. Sometimes, such noses could also be provided by adapters welded to the lip. In other examples, adapters with noses are mechanically attached to the lip. This is usually the case for cable shovel lips. Cast lips have for decades been composed of low-alloy steels because of their high strength and toughness, and their low cost of manufacture.

Cast lips for excavating equipment are usually manufactured by a sand-casting process where molten steel is fed into a sand mold. As with any large steel casting, it is exceedingly difficult to make a defect-free lip casting. It is not unusual for large castings to have some defects in the as-cast condition. Typical defects may be inclusions, hot tears, cracks, porosity, etc. It is a routine practice in the steel foundry business to repair such defects by welding as long as the repairs won't harm the functionality of the finished part. Welding on cast lips is common for other purposes as well. For example, on account of their size, cast lips are at times cast in segments (typically as two or three segments) that are welded together to form a single lip. The cast lip is welded into the bucket. The noses, adapters and shrouds are sometimes welded to the lip. Attachments, such as bosses and the like, are at times welded to the lip for the securing of wear parts. Damage to the lip during use, typically along the front end, is also commonly repaired and/or rebuilt through welding processes.

While in some cases, weld repairs on low alloy cast lips are made with welding filler materials that roughly match the lip material's strength, repair welds are very often made with softer iron-based weld materials such as E70-Series carbon steel filler materials. When weld repairs can be post-weld heat treated (as is sometimes the case for casting repairs in the foundry), the use of matching materials can give advantages in terms of fatigue resistance and wear resistance. If repair welds cannot be post-weld heat treated, then an undermatched filler material may be used. The use of undermatching filler materials is a welding engineering technique that can be extremely helpful for avoiding hydrogen-assisted cracking when welding hardenable steels, particularly when post-weld heat treating cannot be performed. For the same reason, undermatching filler materials are also preferred for fabrication welding, such as welding lips into buckets. These fabrication welds may be quite thick and the associated stresses can be quite significant. Use of the undermatching filler materials limits the magnitude of these stresses greatly increasing the likelihood of making good, crack free fabrication welds. However, the use of a softer weld material makes the lip more susceptible to damage at those locations during use. For example, the softer material is less able to withstand the high and cyclic loads commonly applied during digging, and/or the high level of abrasion typically encountered in digging.

The present disclosure pertains to a cast lip for excavating equipment that is composed of a ferrous alloy having a relatively high level of chromium. In one example, the cast lip can be composed of a ferrous alloy having at least 7% chromium by weight and preferably 10% or more. All the constituent percentages given herein are by weight. A ferrous alloy is one that is at least 50% iron. The lip also preferably has more than or equal to 3% nickel and less than or equal to 0.12% carbon. Other elemental combinations are possible. The lip will be hardened to have a primarily martensitic structure to provide sufficient strength for use as a lip for earth working equipment.

In another example, a cast lip for excavating equipment is composed of a ferrous alloy having at least 10% chromium, at least 3% nickel and less than or equal to 0.12% carbon, and optionally less than or equal to 3% of one or more of each of manganese, silicon and/or molybdenum, and a primarily martensitic structure.

In another example, a cast lip for excavating equipment is composed of a ferrous alloy having between 10%-15% chromium, 3%-6% nickel and less than or equal 0.12% carbon, and a primarily martensitic structure.

In another example, a cast lip for excavating equipment is composed of a ferrous alloy having between 10%-15% chromium, 3%-6% nickel, and less than or equal to 0.10% each of carbon, manganese, silicon and molybdenum, and a primarily martensitic structure. A lower amount of carbon (i.e., ≤0.10%) is preferred for high performance of the lip but up to ≤0.12% can commonly be accepted.

In another example, a cast lip for excavating equipment is composed of an alloy having a CA6NM composition, which is a ferrous-based alloy including less than or equal to 0.06% carbon, less than or equal to 1% manganese, less than or equal to 1% silicon, less than or equal to 0.04% phosphorus, less than or equal to 0.03 sulfur, 11.5%-14% chromium, 3.5%-4.5% nickel and 0.4%-1% molybdenum, and hardened to a primarily martensitic structure. In another example, a cast lip for excavating equipment is composed of a low-carbon stainless steel having a primarily martensitic structure.

While steels with a relatively higher level of chromium (such as found in the stainless steel alloys discussed above) will provide a generally preferred level of the desired benefits, it may alternatively be desirable to reduce costs of the cast lip through use of a non-stainless steel alloy (i.e., one with less but still a sufficiently high level of chromium to gain benefits discussed herein). In such cases, a cast lip for excavating equipment can be composed of a ferrous alloy having 7%-10% chromium and less than or equal 0.12% carbon, and a primarily martensitic structure. In another such example, a cast lip for excavating equipment is composed of a ferrous alloy having 7%-9% chromium and less than or equal 0.12% carbon, and a primarily martensitic structure. Also, as mentioned above for other examples, 3%-6% nickel and/or 3% or less of one or more of manganese, silicon and/or molybdenum. Alternatively, the alloy can be limited to ≤0.1% each of manganese, silicon and/or molybdenum.

By using the chromium alloys as noted above, a weld material that matches or is similar to the base alloy of the lip can be used. For example, if a lip were made of the CA-6NM composition, filler materials of the "410Ni—Mo" composition can be used. Weld deposits made with this material respond to heat treatment much like the CA-6NM base metal and can achieve similar properties as well, when appropriately heat treated. The use of the lips described herein and a welding material of a similar composition can enable the welded area to have a similar strength and abrasion resistance as the base alloy and thereby avoid certain weaknesses encountered in current low-alloy cast lips. Preheating the base material around the area to be welded and heat treating of the welded area after welding can result in a welded area that generally matches the base alloy of the lip in strength and toughness. When post-weld heat treatment is not possible or not desirable (as when fabrication welding a lip into a bucket), a dis-similar austenitic stainless steel filler material like Type 309 may be used for the welding lips of the present disclosure. While this combination is considered unique, it is noted that using an undermatched filler material is a known welding process that is commonly used when fabrication welding highly-hardenable steels such as the conventional low alloy steel lips. While this austenitic filler material is soft, it is useful in avoiding hydrogen-assisted cracking which can be a major concern when welding high strength steels.

Other benefits are also achievable with a cast lip in accordance with the present disclosure. For example, lips in accordance with the present disclosure can provide improvements in yield strength, fatigue strength and/or endurance limits regarding welds, hardness and/or wear life as compared to current lips composed of low-alloy steels. In one example, the table below compares one example of an inventive cast lip alloy (nominally 0.03% C-0.05% Mn-0.6% Si-12.75% Cr-4% Ni-0.5% Mo), as compared to one current low-alloy steel cast lip.

TABLE 1

Mechanical Property v. Improvement

| Mechanical Property | Improvement of Inventive Lip over Current Low-Alloy Lip |
|---|---|
| Yield Strength | 20%-30% |
| Fatigue endurance limit (Repair weld) | 30%-50% |
| Fatigue endurance limit (Factory weld) | 75%-100% |
| Hardness | 20%-25% |
| Wear Life | 0%-20% |

A cast lip in accordance with the present disclosure can maintain significant fatigue strength after welding, be lighter than conventional low-alloy cast steel lips, and/or provide improved strength. These advantages can offset the increased cost associated with the chromium alloys described herein such as by providing, e.g., longer service life, less machine downtime, easier repair and/or component attachment, increased load capacity, better penetration, use of less material and/or corrosion resistant.

The improved mechanical properties of a cast lip in accordance with the present disclosure can enable the use of a slimmer lip for the same excavating machine as compared to a conventional low-alloy cast lip. The reduced weight of the lip provides a greater maximum load for the machine because maximum loads include the weight of the bucket and attachments as well as the load contained in the load. A slimmer profile also eases the penetration of the bucket into the ground during digging. Such a lip in accordance with the disclosure, then, can provide lighter and better penetrating lips, more production by the digging machine, less wear on the equipment and/or faster cycle times. All in all, the advantages lead to a more efficient digging process. Alternatively, a cast lip having the same dimensions as a current low-alloy cast lip can also be used in more robust environments—for example, an inventive lip made with the same dimensions as a low-alloy cast lip made for normal use could be used in a heavy-duty and/or extra heavy-duty environment.

Each of the above-noted examples of the disclosure are suited for use as a cast lip for a large excavating bucket such as found in, e.g., draglines, cable shovels, face shovels and hydraulic excavators. Such lips extend across the width of the bucket to form the bucket's primary digging edge. The above-discussed examples of lips in this disclosure are well suited for use in lips weighing at least 6500 pounds, formed of lip segments of at least 2000 pounds, and/or that have a maximum thickness of at least 9 inches. As examples, such lips can weigh on the order of about 6500 pounds to about 29,000 pounds, lip segments can weigh about 2000 pounds or more prior to being welded together to form a lip, and cast lips can have a maximum thickness ranging from about 4-16 inches, though other variations are possible. The cast lips generally have a varied shape to maximize strength, minimize weight, and/or customize the shape for a particular operation and/or the attachment of wear parts.

In one example, a process for making a lip for earth working equipment in accordance with the present disclosure includes melting one of the above-noted chromium ferrous alloys, feeding the molten alloy into a sand mold to form the alloy into a lip for use with earth working equipment, and hardening the alloy. The lip is preferably air hardened in an ambient environment to form the primarily martensitic structure though a quench is possible. Current low-alloy steel cast lips are quenched to form the desired martensitic structure. After hardening, the cast lip is tempered to provide the desired toughness for use as a lip for earth working equipment. This combination of hardening and tempering can result in a combination of strength and toughness that is desired for a cast lip secured in a bucket of an excavating machine.

Figure 2:
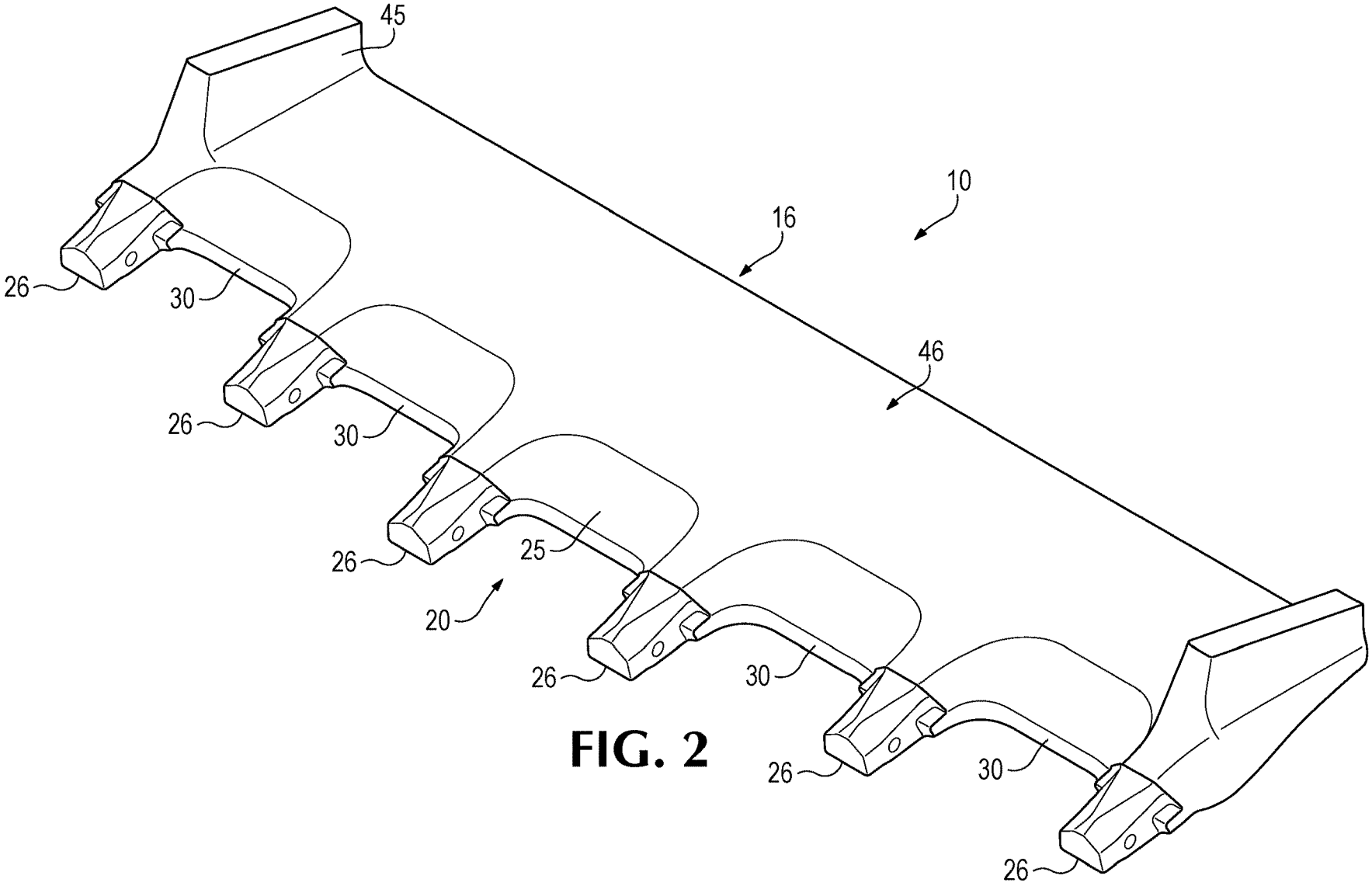
FIG. 2 is a top perspective view of a cast lip.
Figure 3:
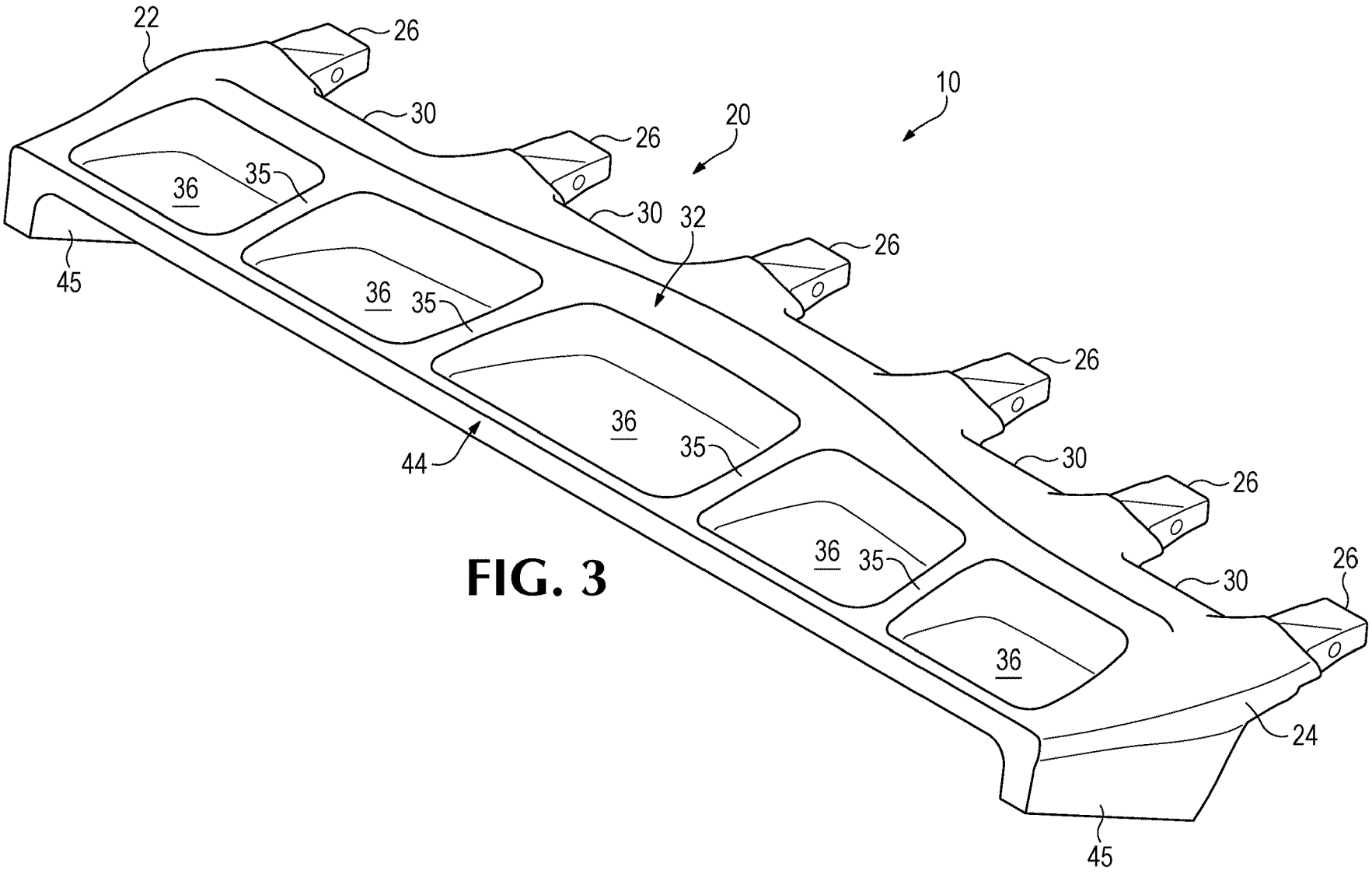
FIG. 3 is bottom perspective view of a cast lip.

Referring to FIGS. 1-3, one example of a cast lip 10 includes a forward portion 20, a rearward portion 16, ears 45 on both sides of the lip 10, upper surface 46, and lower surface 32. The cast lip 10 in accordance with the present disclosure is, e.g., welded to a drag-line bucket 2 at a forward portion 4 of the bucket 2 at a back face 44 at the rear portion 16 of the lip and along wings or ears 45 to bucket body 8. This lip construction is as disclosed in U.S. Pat. No. 9,963,853, which is incorporated herein by reference.

The lip 10 has an elongate construction or length 25 extending between the opposite sidewalls 40 of the bucket 8 (e.g., across the bucket width). The lower surface 32 includes various recesses 36 separated by ridges, ribs, spacers or other structures 35; these recesses lower the weight of the lip while still providing the required strength. This is just one example and other lip constructions are possible.

In the illustrated example, the lip 10 includes a set of noses 26 spaced along the forward portion 20 of the lip 10. The noses 26 extend forward of the main lip structure 25 for mounting ground-engaging tools. The front or forward portion 20 of the lip 10 also includes forward edges 30 between the noses. Ground-engaging parts such as shrouds are typically secured over the forward edges 30. Tooth assemblies typically secure over the noses 26. This lip 10 is shown secured into a dragline bucket but it could be secured in buckets for other machines including, for example, cable shovels, face shovels and/or hydraulic excavators.

Figure 4:
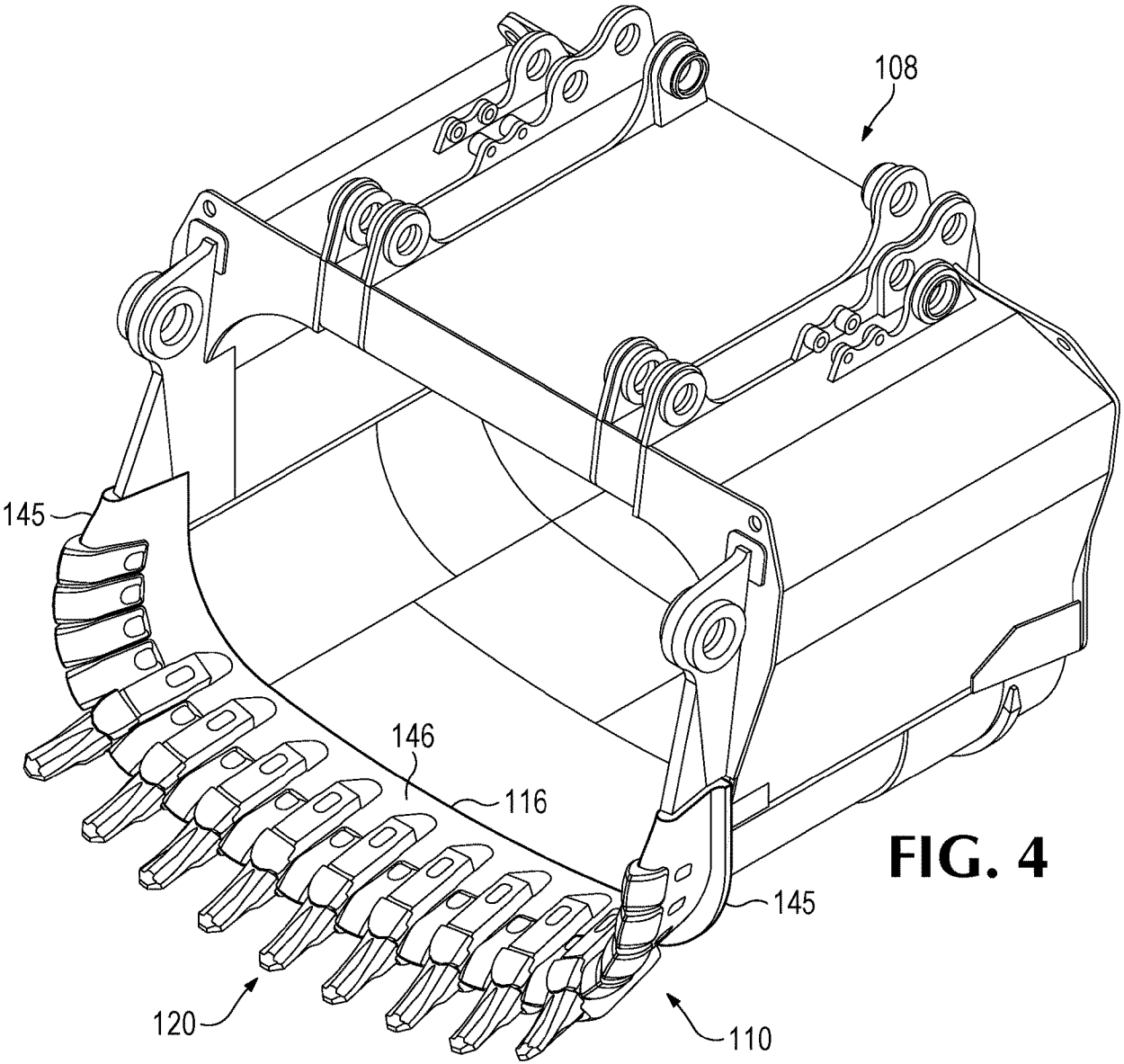
FIG. 4 is a perspective view of a second excavating bucket with a lip in accordance with the present disclosure.
Figure 5:
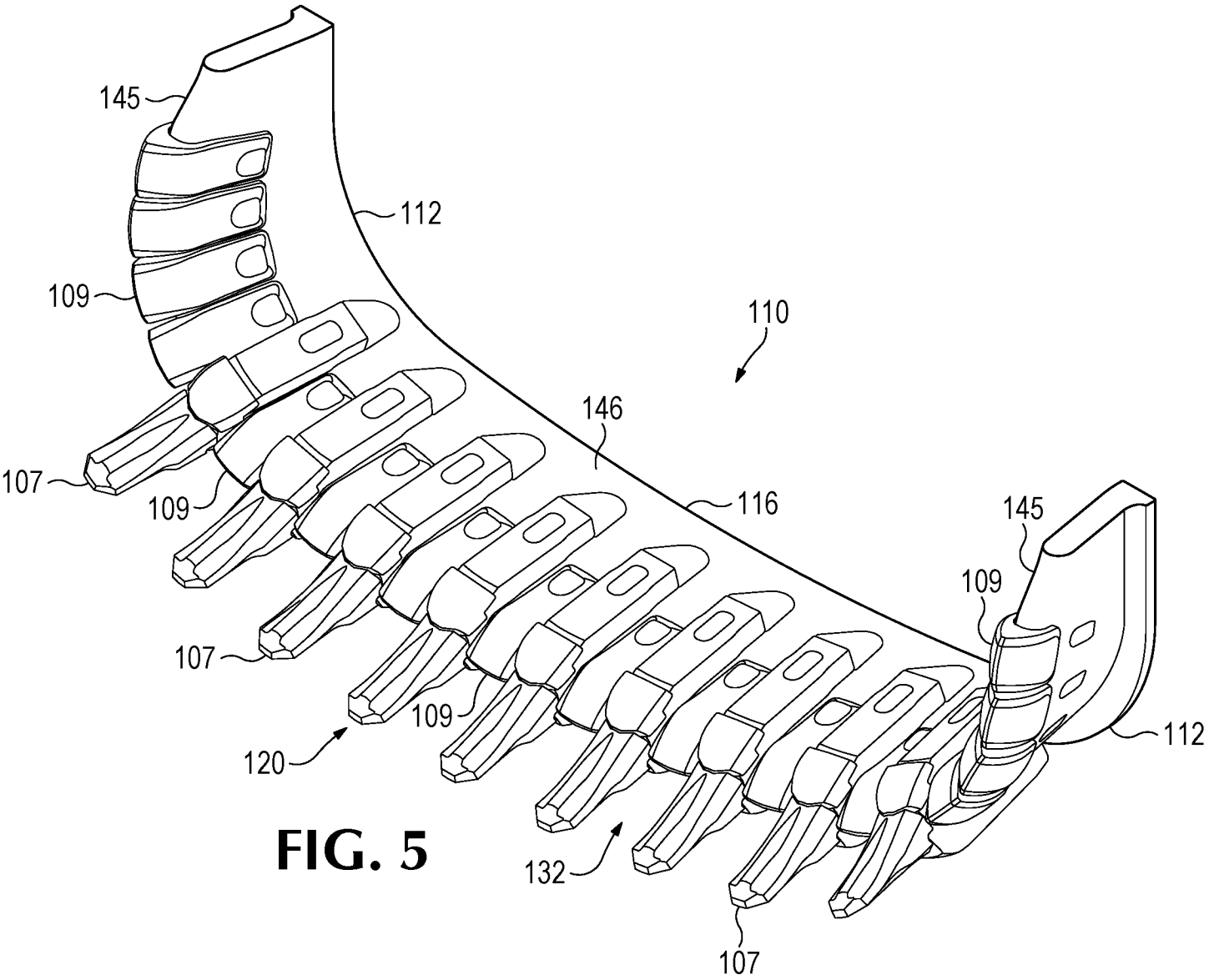
FIG. 5 is a perspective view of another example of a cast lip in accordance with the present disclosure with ground-engaging tools attached.

Referring to FIGS. 4-5, a cable shovel dipper bucket 102 including shell defining a cavity for receiving earthen material is shown with a cast lip 110 and ground-engaging wear products. The lip 110 includes a forward portion 120, a rearward portion 116, ears 145 on both sides of the lip 110, upper surface 146, and lower surface 132. Each ear or wing 145 is curved upward on each end 112 for use in a cable shovel dipper 102. The forward edge is covered with mounting ground-engaging tools, such as tooth assemblies 107 and shrouds 109. The shrouds 109 are illustrated to continue up the wings 145.

These illustrated lips are simply examples; virtually any other cast lip structure is possible with the present disclosure.

The invention claimed is:

1. A cast lip for an excavating bucket defined by at least one cast body having a length to extend between sidewalls of the bucket, the lip being composed of a ferrous alloy having at least 7-10% chromium by weight and 0.12% or less carbon by weight, and a primarily martensitic structure, wherein the ferrous alloy is melted and the molten alloy is fed into a mold to form the alloy into a lip, and the alloy is hardened to form the martensitic structure.

2. The cast lip of claim 1, wherein the ferrous alloy includes 3%-6% nickel by weight.

3. The cast lip of claim 1, wherein the ferrous alloy includes 3% or less by weight of at least one of manganese, silicon and/or molybdenum.

4. The cast lip of claim 1, wherein the ferrous alloy includes 0.10% or less of each of carbon, manganese, silicon, and molybdenum by weight.

5. The cast lip of claim 1, including a plurality of forwardly projecting noses each for mounting a tooth component, and a plurality of mounting areas for mounting shrouds between the plurality of forwardly projecting noses.

6. The cast lip of claim 1, which weighs at least 6500 pounds.

7. The cast lip of claim 1, which has a maximum thickness between 4-16 inches.

8. The cast lip of claim 1, which is composed of 7%-9% chromium by weight.

9. The cast lip of claim 1, wherein the cast lip is connected to a bucket for earth working equipment, the bucket comprising a shell defining a cavity for receiving earthen material.

* * * * *